US006402638B1

(12) United States Patent
Kelley

(10) Patent No.: US 6,402,638 B1
(45) Date of Patent: Jun. 11, 2002

(54) PRACTICE PUTTER

(75) Inventor: Donald J. Kelley, Chandler, AZ (US)

(73) Assignees: Gary W. Phillips, Phoenix; Erwin D. Phillips, Tempe; Mark A. Phillips, Glendale, all of AZ (US)

( * ) Notice: Subject to any disclaimer, the term of this patent is extended or adjusted under 35 U.S.C. 154(b) by 0 days.

(21) Appl. No.: 09/433,171

(22) Filed: Nov. 3, 1999

(51) Int. Cl.[7] ..... A63B 53/04; A63B 53/06; A63B 53/08

(52) U.S. Cl. ..... 473/330; 473/256; 473/340

(58) Field of Search ..... 473/340, 350, 473/330, 252, 324, 332, 236

(56) References Cited

U.S. PATENT DOCUMENTS

| | | | | | |
|---|---|---|---|---|---|
| 1,139,685 | A | | 5/1915 | Legh | |
| 2,472,312 | A | | 6/1949 | Parrish | |
| 3,021,141 | A | | 2/1962 | Polsky et al. | |
| 3,194,564 | A | | 7/1965 | Swan | |
| 3,720,410 | A | | 3/1973 | Saytar | |
| 3,881,733 | A | * | 5/1975 | Csernits | 273/168 |
| D237,397 | S | | 10/1975 | Csernits | |
| 3,966,210 | A | | 6/1976 | Rozmus | |
| 4,290,606 | A | | 9/1981 | Maxwell | |
| D282,480 | S | | 2/1986 | Reynolds, Jr. | |
| 4,846,477 | A | * | 7/1989 | Phelan | 273/175 |
| 4,872,684 | A | | 10/1989 | Dippel | |
| 5,011,153 | A | * | 4/1991 | Watkins | 273/186 |
| D317,807 | S | | 6/1991 | Adams | |
| D324,556 | S | | 3/1992 | Guering, Sr. | |
| D326,302 | S | | 5/1992 | Guerin, Sr. | |
| 5,255,919 | A | | 10/1993 | Johnson | |
| 5,344,149 | A | | 9/1994 | Miller | |
| D356,613 | S | | 3/1995 | Adams et al. | |
| 5,441,268 | A | | 8/1995 | Shier | |
| 5,456,464 | A | | 10/1995 | Davenport et al. | |
| 5,551,695 | A | | 9/1996 | Wolk | |
| 5,607,365 | A | | 3/1997 | Wolf | |
| D378,844 | S | | 4/1997 | Shine | |
| 5,630,765 | A | | 5/1997 | Moore | |
| 5,692,968 | A | | 12/1997 | Shine | |
| 5,759,114 | A | | 6/1998 | Bluto et al. | |
| 5,810,675 | A | | 9/1998 | Weathers | |
| 5,916,035 | A | | 6/1999 | Caiozzo | |

* cited by examiner

*Primary Examiner*—Paul T. Sewell
*Assistant Examiner*—Sneh Varma
(74) *Attorney, Agent, or Firm*—Schmeiser, Olsen & Watts

(57) ABSTRACT

A practice putter head includes a substantially flat centrally located sweet spot, and a pair of surfaces that will deflect the golf ball when various flaws occur in a putter's stroke. In one embodiment, the putter head has a putting surface that includes a centrally located sweet spot, a proximal end, and an opposing distal end. A distal claw defines an inner distal claw surface that extends forward from the distal end of the putting surface and extends proximally, and a proximal claw defines an inner proximal claw surface that extends forward from the proximal end of the putting surface and extends distally. The putter head may also include a distal surface inclining from the distal edge of the sweet spot and a proximal surface inclining from the proximal edge of the sweet spot.

18 Claims, 3 Drawing Sheets

PRACTICE PUTTER

BACKGROUND OF THE INVENTION

1. Technical Field

This invention generally relates to a putter, and more specifically relates to a practice putter.

2. Background Art

The use of putters for golfing is well known. Moreover, it is well known to practice putting by striking a golf ball with a putter, and then attempting to correct a golfer's putting stroke by viewing the results of the putt. For example, practice greens are often used for this purpose.

The use of putting aids to teach golfers correct form during putting is also known. Such putting aids have typically been devices that are removably secured to the head of a putter. More particularly, some such devices have included a pair of parallel guide members that extend from the face of a putter.

DISCLOSURE OF INVENTION

Prior putting aids have not sufficiently indicated the wide variety of flaws that may occur in a golfer's putting stroke. For example, putting aids that secure a pair of parallel guide members to a putting head will not indicate problems that occur in the latter part of a putter's forward stroke. Also, such putting aids do not sufficiently indicate problems with a golfer's back stroke—even if a golfer's back stroke veers, causing the parallel guide members to strike the golf ball, the golf ball may not deflect significantly because the surfaces of the guide members are substantially parallel to the direction that the putter is moving. If the golf ball does not deflect significantly, the golfer may not even know that the parallel guide member struck the ball.

Accordingly, a need exists for a practice putter and a practice putter head that will reveal the wide variety of possible putting stroke flaws. According to the present invention, a practice putter head includes a substantially flat centrally located sweet spot, and a pair of surfaces that will deflect the golf ball when various flaws occur in a putter's stroke. In one embodiment, the putter head has a putting surface that includes a centrally located sweet spot, a proximal end, and an opposing distal end. A distal claw defines an inner distal claw surface that extends forward from the distal end of the putting surface and extends proximally, and a proximal claw defines an inner proximal claw surface that extends forward from the proximal end of the putting surface and extends distally. If the golfer's stroke is flawed, the distal claw or the proximal claw, rather than the sweet spot, will strike the golf ball. Because the inner distal claw surface and the inner proximal claw surface are not parallel to the direction of movement of the putter head, if those surfaces strike the golf ball, the golf ball will be deflected significantly, thereby revealing the flaw in the golfer's stroke.

The putter head may also include a distal surface inclining from the distal edge of the sweet spot and a proximal surface inclining from the proximal edge of the sweet spot. Some flaws in the golfer's stroke are not adequately detected by the inclusion of the claws alone because the golf ball still passes between the claws without being deflected. For example, if the golfer rotates the putter near the end of the forward stroke, the golf ball may have passed through the claws before the flaw occurs. If the golfer's stroke is flawed, and the golf ball passes between the proximal claw and the distal claw, the golf ball will strike the inclined distal surface or the inclined proximal surface. Thus, the flaw will be revealed to the golfer. Alternatively, the putter head may include the inclined proximal surface and the inclined distal surface, but not include the proximal claw or the distal claw.

The foregoing and other features and advantages of the invention will be apparent from the following more particular description of preferred embodiments of the invention, as illustrated in the accompanying drawings.

BRIEF DESCRIPTION OF DRAWINGS

Embodiments of the present invention will hereinafter be described in conjunction with the appended drawings, where like designations denote like elements.

MODES FOR CARRYING OUT THE INVENTION

Figure 1:
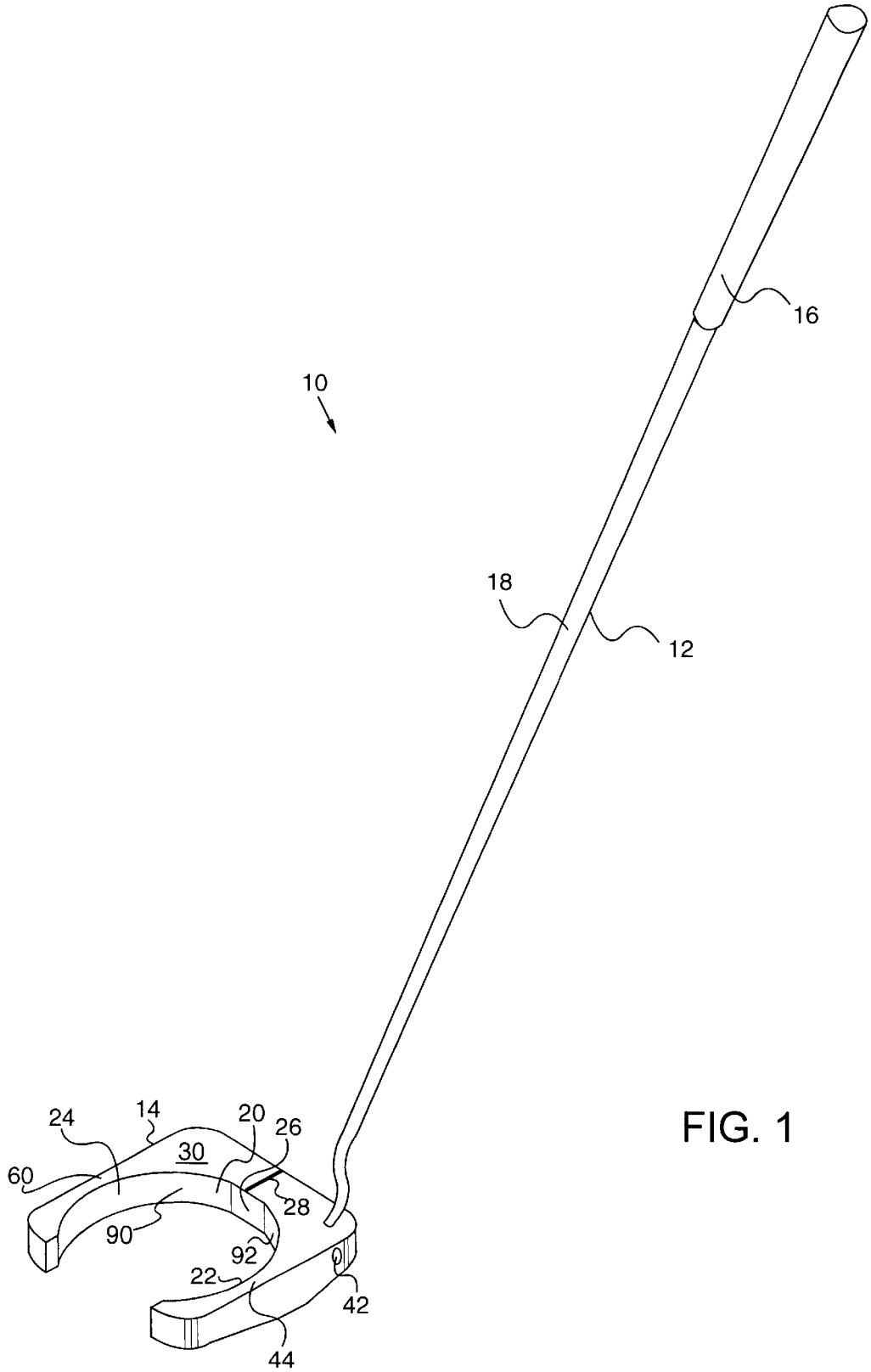
FIG. 1 is a perspective view of a putter according to the present invention.

Referring to FIG. 1, a practice putter 10 according to the present invention includes a handle 12 that is fixed to a head 14. Handle 12 includes a grip 16 and a shaft 18 that extends from grip 16 to head 14. Head 14 defines a substantially forward-facing (i.e., facing substantially in the direction of a properly hit golf ball during use) putting surface 20 that includes a proximal end 22 (the proximal end being proximal to the golfer during use), a distal end 24 (the distal end being distal from the golfer during use), and a sweet spot 26 intermediate proximal end 22 and distal end 24. An alignment line 28 preferably extends along the top surface 30 of head 14 from the center of sweet spot 26 rearwardly and perpendicular to sweet spot 26. Alignment line 28 may be any line that contrasts with top surface 30. Preferably, alignment line 28 is a groove formed in top surface 30 that is colored so that it contrasts from the color of top surface 30. For example, top surface 30 may be gold, while alignment line 28 is black.

In use, a golfer preferably grasps grip 16 and aligns head 14 with a golf ball so that sweet spot 26 is perpendicular to the line of sight (the direction the golfer wishes to hit the golf ball) and alignment line 28 is aligned with the center of the golf ball. The golfer brings head 14 to rest with sweet spot 26 abutting the golf ball. The golfer then proceeds with a back stroke, wherein the golfer swings head 14 rearwardly away from the golf ball along the line of sight keeping sweet spot 26 perpendicular to the line of sight. The golfer then proceeds with a forward stroke, wherein the golfer swings head 14 forwardly toward the golf ball along the line of sight while keeping sweet spot 26 perpendicular to the line of sight, striking the golf ball so that the golf ball travels forwardly along the line of sight. While such a putting stroke is effective, numerous flaws in a putter's stroke can cause putter 10 to mishit the ball so that the ball does not travel along the line of sight as intended. Practice putter 10 reveals the flaws in a putter's stroke so that those flaws can be corrected during practice.

Preferably, head 14 defines a hole 40 (see FIG. 2) that slants downwardly and distally from top surface 30. Hole 40 preferably receives an end of shaft 18, and the end of shaft 18 is preferably fixed within hole 40 by an epoxy. However, those of skill in the art will appreciate that shaft 18 may be secured to head 14 by any of several ways that are known in the art. For example, hole 40 and the end of shaft 18 may be threaded so that shaft 18 can be screwed into hole 40, or shaft 18 may be fixed within hole 40 by brazing shaft 18 to head 14.

Preferably, putter 10 is designed so that the putter is reverse-face balanced. In other words, putter 10 is designed so that when the putter is balanced, sweet spot 26 of putter 10 will face downwardly, rather than facing to the side. For example, when putter 10 is balanced so that shaft 18 is resting on a person's finger, sweet spot 26 will be substantially horizontal and will face downwardly. If a putter is not face balanced or reverse-face balanced, putter 10 may tend to twist when head 14 strikes a golf ball so that putting surface 20 is not perpendicular to the line of sight and the hit golf ball veers from the line of sight. Hole 42 extends from a side of head 14 parallel to top surface 30 and putting surface 20. Hole 42 is preferably partially filled with a material that is heavier than the material for head 14. Putter 10 is preferably balanced having a double bend in shaft 18 near head 14, and by varying the amount of material in hole 42. By varying the amount of material in hole 42, the weight of putter 10 may also be optimized. However, those skilled in the art will appreciate that putter 10 may be balanced and its weight may be optimized by any of other various methods, such as by including and varying the amount of weighted material within shaft 18 near head 14.

Figure 2:
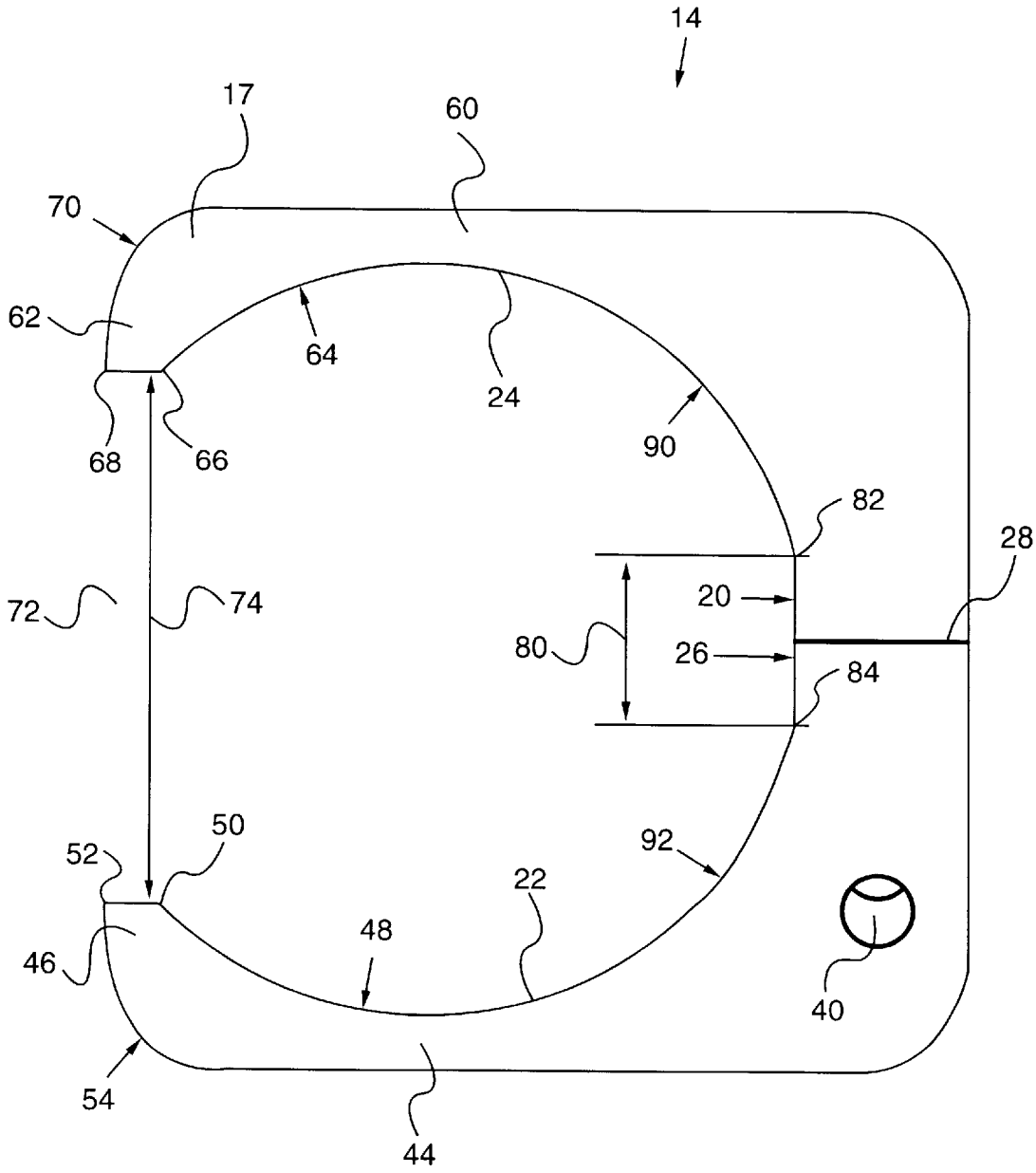
FIG. 2 is a top plan view of a putter head according to the present invention.

Referring now to FIG. 2, head 14 preferably includes a proximal claw 44 that extends forward from proximal end 22 of putting surface 20 and extends distally to a terminus 46. Proximal claw 44 defines an inner proximal claw surface 48 that extends forward from proximal end 22 of putting surface 20 and extends distally to terminus 46. Preferably, proximal claw surface 48 is a concave arcuate surface. In a preferred embodiment, proximal claw surface 48 is a concave arcuate surface having a constant radius of curvature of about 1.375 inches. However, proximal claw surface 48 may be any of other various shapes so long as it extends forward from proximal end 22 of putting surface 20 and extends distally to terminus 46. Terminus 46 preferably includes an inner corner 50 and an outer corner 52. However, corners 50, 52 may be rounded, and moreover, entire terminus 46 may be rounded. An outer proximal claw surface 54 preferably extends proximally from terminus 46 and rearwardly to form an outer surface of head 14.

Head 14 also preferably also includes a distal claw 60 that extends forward from distal end 24 of putting surface 20 and extends proximally to a terminus 62. Distal claw 60 defines an inner distal claw surface 64 that extends forward from distal end 24 of putting surface 20 and extends proximally to terminus 62. Preferably, inner distal claw surface 64 is a concave arcuate surface. In a preferred embodiment, inner distal claw surface 64 is a concave arcuate surface having a constant radius of curvature of about 1.375 inches. However, inner distal claw surface 64 may be any of other various shapes so long as it extends forward from distal end 24 of putting surface 20 and extends proximally to terminus 62. Terminus 62 preferably includes an inner corner 66 and an outer corner 68. However, corners 66, 68 may be rounded, and moreover, entire terminus 62 may be rounded. An outer distal claw surface 70 preferably extends distally from terminus 62 and rearwardly to form an outer surface of head 14.

Terminus 46 of proximal claw 44 and terminus 62 of distal claw 60 define a mouth 72 therebetween having a width 74. Width 74 should be wide enough that a standard size golf ball can pass through mouth 72. A standard size golf ball is preferably sized as defined by the official golf rule-making body where putter 10 is being used. If such a rule-making body defines a minimum size, then the standard size is preferably that minimum size. Width 74 is preferably wide enough so that if the golfer has a good stroke, the ball will pass through mouth 72, but narrow enough that if the golfer has a flawed stroke, the ball will not pass through mouth 72. Width 74 may vary depending on the distance between mouth 72 and sweet spot 26. When mouth 72 is about 2.5 inches from sweet spot 26 (i.e., the distance from the forward-most portion of the mouth that extends between corner 68 and corner 52 to sweet spot 26 is about 2.5 inches), width 74 is preferably from about 1.95 inches to about 1.97 inches. In a preferred embodiment, wherein mouth 72 is about 2.5 inches from sweet spot 26, width 74 is about 1.95 inches.

Preferably, sweet spot 26 is substantially flat, having a width 80, a distal edge 82, and an opposing proximal edge 84. Width 80, the width of the sweet spot that can be struck by a golf ball, should be large enough so that if the golfer has a good stroke, the ball will strike sweet spot 26, but it should small enough so that if the golfer has a flawed stroke, the ball will not strike sweet spot 26. Width 80 is preferably from about 0.33 inch to about 0.43 inch. In a preferred embodiment, width 80 is about 0.375 inch, with about 0.1875 inch on each side of alignment line 28.

Putting surface 20 preferably includes sweet spot 26, a distal surface 90, and a proximal surface 92. Distal surface 90 preferably inclines from distal edge 82 of sweet spot 26. Distal surface 90 may incline from distal edge 82 at any of various directions, but distal surface 90 is preferably not coplanar with sweet spot 26 so that a ball that strikes distal surface 90 will not be hit along the line of sight. Distal surface 90 is preferably a concave arcuate surface. In a preferred embodiment, distal surface 90 is a concave arcuate surface having a constant radius of curvature of about 1.375 inches. Moreover, in a preferred embodiment, distal surface 90 inclines forwardly and distally from distal edge 82 of sweet spot 26 and extends to meet inner distal claw surface 64. However, distal surface 90 could be some other shape and it could incline in some other direction. For example, distal surface 90 could incline distally and rearwardly from distal edge 82 to meet inner distal claw surface 64, which would then extend forwardly and proximally from behind sweet spot 26. A proximal surface 92 preferably inclines from proximal edge 84 of sweet spot 26. Proximal surface 92 may incline from proximal edge 84 at any of various directions, but proximal surface 92 is preferably not coplanar with sweet spot 26 so that a ball that strikes proximal surface 92 will not be hit along the line of sight. Proximal surface 92 is preferably a concave arcuate surface. In a preferred embodiment, proximal surface 92 is a concave arcuate surface having a constant radius of curvature of about 1.375 inches. Moreover, in a preferred embodiment, proximal surface 92 inclines forwardly and proximally from proximal edge 84 of sweet spot 26 and extends to meet inner proximal claw surface 48. However, proximal surface 92 could be some other shape and it could incline in some other direction. For example, proximal surface 92 could incline proximally and rearwardly from proximal edge 84 to meet inner proximal claw surface 48, which would then extend forwardly and distally from behind sweet spot 26.

The incline of distal surface 90, the incline of proximal surface 92, and width 80 of sweet spot 26 allow a standard golf ball to strike sweet spot 26. Preferably, the width 80 of sweet spot 26 that a standard golf ball can strike is about 0.375 inch, as discussed above.

Figure 3:
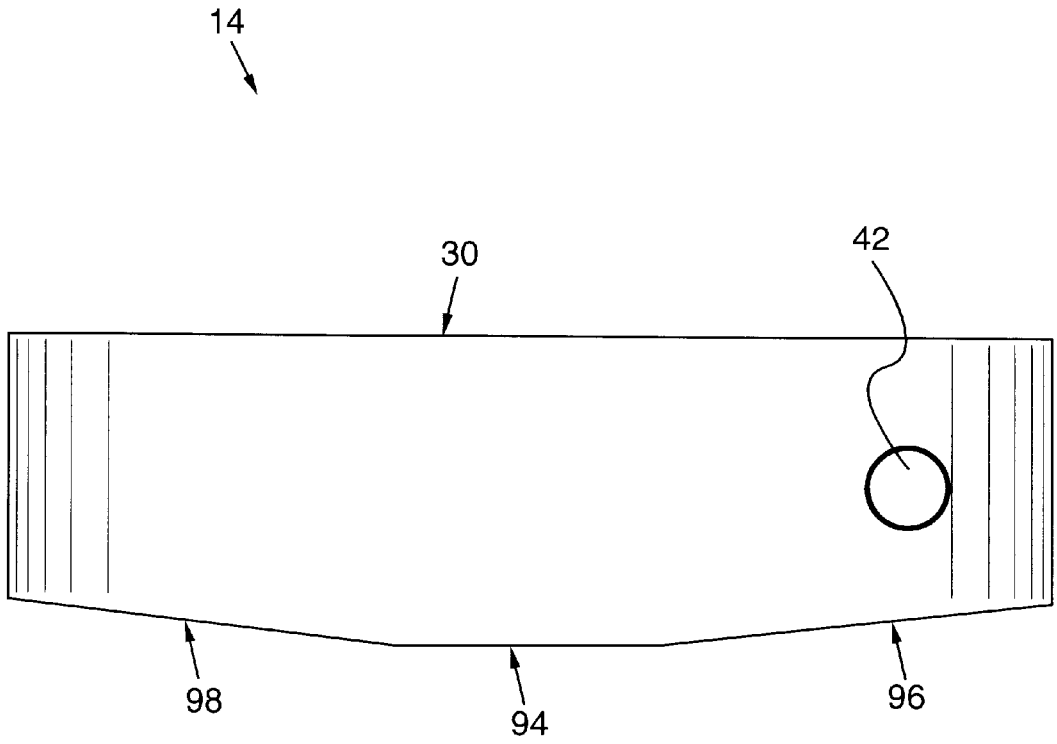
FIG. 3 is a side plan view of the putter head of FIG. 2.

Referring now to FIG. 3, a downwardly-facing base surface 94 extends from the proximal side of head 14 to the distal side of head 14. Base surface 94 is preferably perpendicular to sweet spot 26. A follow through clearance surface 96 preferably inclines rearwardly and upwardly from base surface 94, having an incline that allows head 14 to clear the ground during a golfer's follow through on the forward stroke. A back stroke clearance surface 98 preferably inclines forwardly and upwardly from base surface 94, having an incline that allows head 14 to clear the ground during a golfer's back stroke.

Referring back to FIG. 1, in making putter 10, head 14 is preferably formed by machining an aluminum plate. Those skilled in the art will appreciate that many various specific machining methods or other manufacturing methods may be used to form head 14, and head 14 may be formed from any of various materials. In a preferred embodiment, head 14 is 6061 aluminum, and head 14 is formed by milling an aluminum plate. After machining head 14, the surfaces of head 14 are preferably shot peened using a bead blast. In a preferred embodiment, head 14 is then gold anodized from about 0.002 to about 0.003 inch thick to give head 14 a gold appearance and to harden the surface of head 14.

Shaft 18 is preferably a commercially available double bend putter shaft, such as the double bend putter shafts available from True Temper Sports, Inc. in Carlsbad, Calif. However, shaft 18 may be any known shaft material and it may be in any configuration that can be fixed to a putter head and a grip. Preferably, about 0.4 inch at the bottom of shaft 18 is sanded to aid in adhesion. An adhesive is then applied to hole 40 and to the bottom of shaft 18. The adhesive is preferably an epoxy. The bottom of shaft 18 is inserted into hole 40 such that a plane that includes the double bend in shaft 18 is substantially parallel to sweet spot 26. Any excess epoxy can be removed by wiping it away. The assembly including shaft 18 and head 14 is then placed so that shaft 18 does not move relative to head 14 and the epoxy is allowed to set.

Grip 16 is preferably a standard putter grip, which includes a thumb rest. However, grip 16 may be any of various known grip materials, and it may be in any configuration that allows a golfer to grasp the grip and to maneuver the shaft and head of the putter. In a preferred embodiment, grip 16 is fixed to shaft 18 by wrapping double back tape to about the top 7 inches of shaft 18. Tape actuator is then poured into grip 16 and over the tape on shaft 18. Grip 16 is then immediately slid over the tape on shaft 18, and grip 16 is rotated relative to shaft 18 so that the thumb rest faces distally.

Weighted material is then placed in hole 42 to bring putter 10 and head 14 to their desired weights, and to balance putter 10 as described above. The desired weight may depend on, among other things, the length of shaft 18. The weighted material is preferably a heavy material that is non-toxic. In a preferred embodiment, the heavy material is tungsten carbide. However, it may be any of various other materials, such as brass. An adhesive, such as an epoxy, may be inserted into hole 42 to hold the heavy material in place.

In use, a golfer grasps grip 16, and positions head 14 so that sweet spot 26 abuts a golf ball, and so that alignment line 28 is aligned with the center of the golf ball. The golfer performs a back stroke, wherein the golfer swings head 14 rearwardly away from the golf ball. Finally, the golfer performs a forward stroke, wherein the golfer swings head 14 forwardly toward the golf ball and follows through after striking the golf ball. With a correct stroke, alignment line 28 will travel along the line of sight during the back stroke and the forward stroke, and sweet spot 26 will remain perpendicular to the line of sight.

During the back stroke, the golfer may push head 14 so that alignment line 28 veers distally from the line of sight, or the golfer may rotate head 14 clockwise (from the perspective of the golfer). If the golfer pushes the head distally from the line of sight during the back stroke, the golfer will likely push the head proximally toward the golf ball during the forward stroke, and a golf ball will likely veer proximally from the line of sight after being struck with a traditional putter. If the golfer rotates the head clockwise during the back stroke, and the head remains in this position, the golf ball will likely veer distally from the line of sight after being struck with a traditional putter. If either or both of these flaws occur using putter 10, the golf ball will strike inner corner 50 of proximal claw 44, or if the flaw is even worse, the golf ball will strike inner proximal claw surface 48 during the back stroke. When inner corner 50 or inner proximal claw surface 48 strikes the golf ball, the golfer's flaw will become apparent to the golfer and the golfer can practice to correct the flaw or flaws.

Also, during the back stroke, the golfer may pull head 14 so that alignment line 28 veers proximally from the line of sight, or the golfer may rotate head 14 counterclockwise (from the perspective of the golfer). If the golfer pulls the head proximally from the line of sight during the back stroke, the golfer will likely push the head distally toward the golf ball during the forward stroke, and the golf ball will likely veer distally from the line of sight after being struck with a traditional putter. If the golfer rotates the head clockwise during the back stroke, and the head remains in this position, the golf ball will likely veer distally from the line of sight after being struck with a traditional putter. If either or both of these flaws occur using putter 10, the golf ball will strike inner corner 66 of distal claw 60, or if the flaw is even worse, the golf ball will strike inner distal claw surface 64 during the back stroke. When the golf ball strikes inner corner 66 or inner distal claw surface 64, the golfer's flaw will become apparent to the golfer and the golfer can practice to correct the flaw.

During the forward stroke, the golfer may push head 14 so that alignment line 28 veers distally from the line of sight, or the golfer may rotate head 14 clockwise (from the perspective of the golfer). If the golfer pushes the head distally from the line of sight during the forward stroke, a golf ball will likely veer distally from the line of sight after being struck with a traditional putter. If the golfer rotates the head clockwise during the forward stroke, the golf ball will likely veer distally from the line of sight after being struck with a traditional putter. If either or both of these flaws occur using putter 10, the golf ball will strike outer corner 52 of proximal claw 44, or if the flaw is even worse, the golf ball will strike outer proximal claw surface 54 during the forward stroke. When the golf ball strikes outer corner 52 or outer proximal claw surface 54, the golfer's flaw or flaws will become apparent to the golfer and the golfer can practice to correct the flaw or flaws.

Also, during the forward stroke, the golfer may pull head 14 so that alignment line 28 veers proximally from the line of sight, or the golfer may rotate head 14 counterclockwise (from the perspective of the golfer). If the golfer pulls the head proximally from the line of sight during the forward stroke, the golf ball will likely veer proximally from the line of sight after being struck with a traditional putter. If the golfer rotates the head counterclockwise during the forward stroke and the head remains in this position, the golf ball will likely veer proximally from the line of sight after being struck with a traditional putter. If either or both of these flaws occur using putter 10, the golf ball will strike outer corner 68 of distal claw 60, or if the flaw is even worse, the golf ball will strike outer distal claw surface 70 during the forward stroke. When the golf ball strikes outer corner 68 or outer distal claw surface 70, the golfer's flaw or flaws will become apparent to the golfer and the golfer can practice to correct the flaw or flaws.

If the golfer pushes head 14 so that alignment line 28 veers distally from the line of sight, or if the golfer rotates head 14 counterclockwise just before head 14 strikes the golf ball, it is possible that none of the surfaces described above will strike the golf ball even if the golf ball will not be aligned with alignment line 28 when head 14 strikes the golf ball. If the golfer pushes the head distally from the line of sight during the forward stroke, a golf ball will likely veer distally from the line of sight after being struck with a traditional putter. If the golfer rotates the head counterclockwise during the latter part of the forward stroke, the golf ball will likely veer proximally from the line of sight after being struck with a traditional putter. If either or both of these flaws occur when using putter 10 and the golf ball passes between proximal claw 44 and distal claw 60, the golf ball will strike proximal surface 92. When the golf ball strikes proximal surface 92, the golf ball will not exit head 14 normally and the golfer's flaw or flaws will become apparent to the golfer. The golfer can then practice to correct the flaw or flaws.

If the golfer pulls head 14 so that alignment line 28 veers proximally from the line of sight, or if the golfer rotates head 14 clockwise just before head 14 strikes the golf ball, it is possible that none of the surfaces described above will strike the ball even if the ball will not be aligned with alignment line 28 when head 14 strikes the golf ball. If the golfer pulls the head proximally from the line of sight during the forward stroke, a golf ball will likely veer proximally from the line of sight after being struck with a traditional putter. If the golfer rotates the head clockwise during the latter part of the forward stroke, the golf ball will likely veer distally from the line of sight after being struck with a traditional putter. If either or both of these flaws occur when using putter 10 and the golf ball passes between proximal claw 44 and distal claw 60, the golf ball will strike distal surface 90. When the golf ball strikes distal surface 90, the golf ball will not exit head 14 normally and the golfer's flaw will become apparent to the golfer. The golfer can then practice to correct the flaw or flaws.

Preferably, the golfer repeatedly practices his or her back stroke and forward stroke, observing where the golf ball strikes head 14 of putter 10, and realizing the golfer's probable flaws from the observation. After realizing a flaw, the golfer practices his or her back stroke and forward stroke again, attempting to correct the flaw. If the golf ball passes through mouth 72 during the back stroke and forward stroke, and the ball strikes sweet spot 26, the golfer's stroke is proper and the ball will follow the line of sight when using a regular putter. However, even if the golfer performs a single proper stroke, the golfer should continue to practice to achieve and maintain consistent proper putting form.

While the invention has been particularly shown and described with reference to preferred embodiments thereof, it will be understood by those skilled in the art that various changes in form and details may be made therein without departing from the spirit and scope of the invention.

For example, putting surface 20 can be any of several shapes besides that shown in the figures, such as where the distal surface and the proximal surface extend rearwardly, rather than forwardly from the sweet spot, or where the entire putting surface 20 is substantially flat. In fact, it is possible that a standard golf ball may not be able to strike some portion of putting surface 20.

What is claimed is:

1. A practice putter head, comprising:

a putting surface including a centrally located substantially flat sweet spot, a proximal end, and an opposing distal end;

a distal claw defining an inner distal claw surface that extends forward and proximally from the distal end of the putting surface; and a proximal claw defining an inner proximal claw surface that extends forward and distally from the proximal end of the putting surface.

2. The putter head of claim 1, wherein the sweet spot has a width that is about 0.375 inch.

3. The putter head of claim 1, wherein the putter head further includes a distal surface inclining from a distal edge of the sweet spot and a proximal surface inclining from a proximal edge of the sweet spot.

4. The putter head of claim 3, wherein the distal surface is a concave arcuate surface, and the proximal surface is a concave arcuate surface.

5. The putter head of claim 1, wherein the inner proximal claw surface is a concave arcuate surface, and the inner distal claw surface is a concave arcuate surface.

6. The putter head of claim 1, wherein the proximal claw and the distal claw each form a terminus, the terminus of the distal claw and the terminus of the proximal claw defining a mouth therebetween.

7. The putter head of claim 6, wherein a distance across the mouth is such that a standard size golf ball can pass through the mouth.

8. A practice putter head, comprising:

a putting surface including a centrally located substantially flat forward-facing sweet spot having a width; a prosinal end, and an opposite distal end;

a distal surface inclining from a distal edge of the sweet spot; and a proximal surface inclining from an opposing proximal edge of the sweet spot, the width of the sweet spot and the inclines of the distal surface and the proximal surface being such as to allow a standard golf ball to contact the sweet spot;

a distal claw defining an inner distal claw surface that extends forward and proximally from the distal end of the putting surface; and a proximal claw defining an inner proximal claw surface that extends forward and distally from the proximal end of the putting surface.

9. The putter head of claim 8, wherein the width of the sweet spot is about 0.375 inch.

10. The putter head of claim 8, wherein the proximal surface inclines proximally and forwardly from the proximal edge of the sweet spot, and wherein the distal surface inclines distally and forwardly from the distal edge of the sweet spot.

11. The putter head of claim 10, wherein the distal surface is a concave arcuate surface, and the proximal surface is a concave arcuate surface.

12. The putter head of claim 1, wherein the inner proximal claw surface is a concave arcuate surface, and the inner distal claw surface is a concave arcuate surface.

13. A practice putter, comprising:

a handle; and a putter head connected to the handle, the putter head comprising:

a putting surface including a centrally located substantially flat forward-facing sweet spot having a width, the sweet spot defining a distal edge and an opposing proximal edge;

a distal surface inclining from the distal edge of the sweet spot;

a proximal surface inclining from the proximal edge of the sweet spot, the width of the sweet spot and the inclines of the distal surface and the proximal surface being such as to allow a standard golf ball to contact the sweet spot;

a distal claw defining an inner distal claw surface that extends forward and proximally from the distal surface; and a proximal claw defining an inner proximal claw surface that extends forward and distally from the proximal surface.

14. The putter head of claim 13, wherein the proximal surface inclines proximally and forwardly from the proximal edge of the sweet spot, and wherein the distal surface inclines distally and forwardly from the distal edge of the sweet spot.

15. The putter head of claim 14, wherein the inner proximal claw surface is a concave arcuate surface, and the inner distal claw surface is a concave arcuate surface.

16. The putter head of claim 15, wherein the distal surface is a concave arcuate surface, and the proximal surface is a concave arcuate surface.

17. The putter head of claim 16, wherein the proximal claw and the distal claw each form a terminus, the terminus of the distal claw and the terminus of the proximal claw defining a mouth therebetween, and wherein a distance across the mouth is about 1.95 inches and a distance from the mouth to the sweet spot is about 2.5 inches.

18. The putter head of claim 13, wherein the width of the sweet spot is about 0.375 inch.

* * * * *